US005865485A

United States Patent [19]

Lawhorne, Jr.

[11] Patent Number: 5,865,485

[45] Date of Patent: Feb. 2, 1999

[54] VEHICLE DOOR LOCKING SYSTEM

[76] Inventor: Jesse H. Lawhorne, Jr., 14 E. Sunset Ave., Williamsport, Md. 21795

[21] Appl. No.: 960,979

[22] Filed: Oct. 30, 1997

[51] Int. Cl.[6] ..... E05C 19/18

[52] U.S. Cl. ..... 292/289; 292/258; 292/288

[58] Field of Search ..... 292/258, 259, 292/259 A, 288, 289, DIG. 60; 70/14, 18

[56] References Cited

U.S. PATENT DOCUMENTS

| | | | |
|---|---|---|---|
| D. 346,106 | 4/1994 | Walls | D8/339 |
| 2,514,738 | 7/1950 | Bradley | 292/288 |
| 3,583,743 | 6/1971 | Newell | 292/288 |
| 3,615,114 | 10/1971 | Harris | 292/288 |
| 4,003,227 | 1/1977 | Casey | 292/258 |
| 4,666,106 | 5/1987 | Kohout | 70/14 |
| 4,669,934 | 6/1987 | Wisecarver | 292/259 R |
| 4,958,867 | 9/1990 | Champagne | 292/259 R |
| 5,431,461 | 7/1995 | Anderson, III et al. | 292/288 |
| 5,447,346 | 9/1995 | Virzi | 292/289 |

FOREIGN PATENT DOCUMENTS

| | | | |
|---|---|---|---|
| 4237061 | 1/1994 | Germany | 292/289 |

*Primary Examiner*—Darnell M Boucher

[57] ABSTRACT

A door locking system is provided including a pair of doors of a vehicle adapted to pivot outward for allowing access to a cab. Each door has a slot for receiving a sliding window therein. A pair of hollow rigid tubes of a common length include a first tube and a second tube. In use, a first end of the first tube is slidably situated within a first end of the second tube. A locking mechanism is connected between the tubes for selectively fixing a combined length thereof. As such, the tubes are extended such that second ends of the tubes are connected to the doors and further the locking mechanism is used to secure the same therebetween to preclude the doors from being opened.

2 Claims, 2 Drawing Sheets

FIG 3
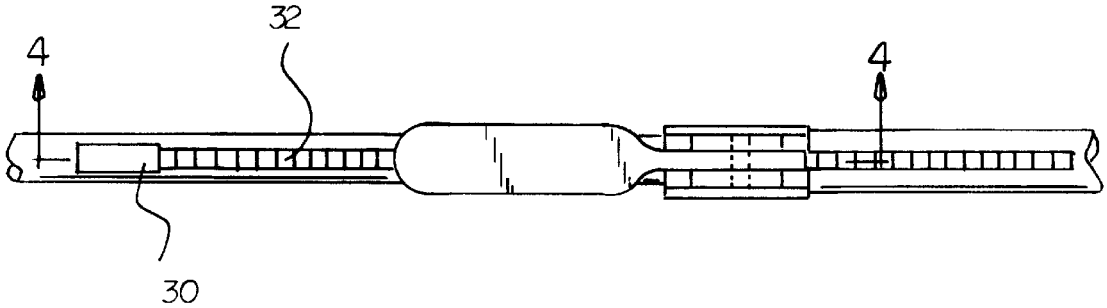
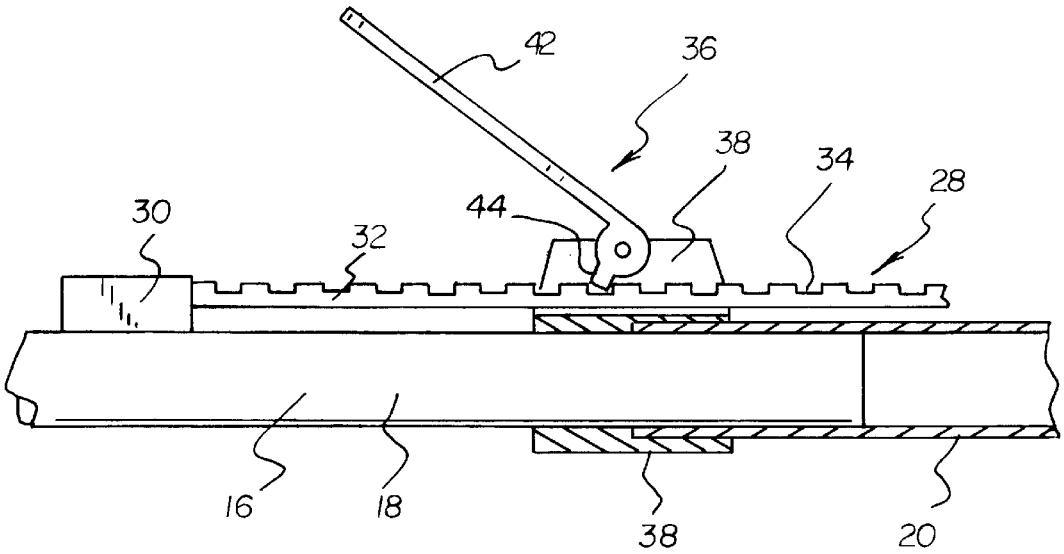
FIG 4

VEHICLE DOOR LOCKING SYSTEM

BACKGROUND OF THE INVENTION

1. Field of the Invention

The present invention relates to door locks and more particularly pertains to a new vehicle door locking system for precluding a pair of doors of a vehicle from being opened.

2. Description of the Prior Art

The use of door locks is known in the prior art. More specifically, door locks heretofore devised and utilized are known to consist basically of familiar, expected and obvious structural configurations, notwithstanding the myriad of designs encompassed by the crowded prior art which have been developed for the fulfillment of countless objectives and requirements.

Known prior art door locks include U.S. Pat. Nos. 5,209,533; 4,330,147; 5,378,095; 4,979,769; 5,419,165; and U.S. Pat. No. Des. 351,551.

In these respects, the vehicle door locking system according to the present invention substantially departs from the conventional concepts and designs of the prior art, and in so doing provides an apparatus primarily developed for the purpose of precluding a pair of doors of a vehicle from being opened.

SUMMARY OF THE INVENTION

In view of the foregoing disadvantages inherent in the known types of door locks now present in the prior art, the present invention provides a new vehicle door locking system construction wherein the same can be utilized for precluding a pair of doors of a vehicle from being opened.

The general purpose of the present invention, which will be described subsequently in greater detail, is to provide a new vehicle door locking system apparatus and method which has many of the advantages of the door locks mentioned heretofore and many novel features that result in a new vehicle door locking system which is not anticipated, rendered obvious, suggested, or even implied by any of the prior art door locks, either alone or in any combination thereof.

To attain this, the present invention generally comprises a pair of doors of a vehicle adapted to pivot outward for allowing access to a cab. Each door has a slot for receiving a sliding window therein. A pair of hollow rigid tubes of a common length are provided including a first tube with a first diameter. Associated therewith is a second tube of a second diameter greater than the first diameter. During use, a first end of the first tube is slidably situated within a first end of the second tube. Also included is a pair of caps each having a hollow cylindrical portion with an open circular face and a planar rectangular plate mounted to a closed face thereof. As shown in FIGS. 1 & 2, the plates extend in perpendicular relationship with an axis of the cylindrical portion. The cylindrical portions of the caps are each mounted to a second of the corresponding tube such that the plates extend downwardly and reside in vertical planes. FIGS. 3 & 4 best shows a teeth assembly including a mounting block secured to a top of the first tube adjacent the first end thereof. An elongated strip has a first end coupled to a side face of the mounting block adjacent to a top face thereof. In such orientation, the strip is positioned in spaced parallel relationship with the first tube and extends past the first end thereof. A top face of the strip has a plurality of equally spaced square cut outs formed therein along an entire length thereof. For reasons that will become apparent hereinafter, each cut out and each space between the cut outs is about ⅛ of an inch in length. Finally, a locking mechanism is provided including a cylindrical sleeve mounted on the first end of the second tube. A pair of parallel arms are integrally coupled to sides of the sleeve and extend upwardly therefrom above the strip of the teeth assembly A lever lock includes an elongated handle pivotally coupled at an end thereof between upper ends of the arms. Such pivotal coupling is effected about an axis perpendicular with respect to that of the tubes. The lever lock has a tab fixedly coupled perpendicularly to the end of the handle above the strip of the teeth assembly. During use, the handle has a raised orientation for allowing the free sliding of the first tube within the second tube. In addition, the handle has a lowered orientation for bringing the tubes together by about ⅛ of an inch and further locking their respective position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new vehicle door locking system apparatus and method which has many of the advantages of the door locks mentioned heretofore and many novel features that result in a new vehicle door locking system which is not anticipated, rendered obvious, suggested, or even implied by any of the prior art door locks, either alone or in any combination thereof.

It is another object of the present invention to provide a new vehicle door locking system which may be easily and efficiently manufactured and marketed.

It is a further object of the present invention to provide a new vehicle door locking system which is of a durable and reliable construction.

An even further object of the present invention is to provide a new vehicle door locking system which is susceptible of a low cost of manufacture with regard to both materials and labor, and which accordingly is then susceptible of low prices of sale to the consuming public, thereby making such vehicle door locking system economically available to the buying public.

Still yet another object of the present invention is to provide a new vehicle door locking system which provides in the apparatuses and methods of the prior art some of the advantages thereof, while simultaneously overcoming some of the disadvantages normally associated therewith.

Still another object of the present invention is to provide a new vehicle door locking system for precluding a pair of doors of a vehicle from being opened.

Even still another object of the present invention is to provide a new vehicle door locking system that includes a pair of doors of a vehicle adapted to pivot outward for allowing access to a cab. Each door has a slot for receiving a sliding window therein. A pair of hollow rigid tubes of a common length include a first tube and a second tube. In use, a first end of the first tube is slidably situated within a first end of the second tube. A locking mechanism is connected between the tubes for selectively fixing a combined length thereof. As such, the tubes are extended such that second ends of the tubes are connected to the doors and further the locking mechanism is used to secure the same therebetween to preclude the doors from being opened.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a top view of the present invention.

FIG. 4 is a cross-sectional view of the present invention taken along line 4—4 shown in FIG. 3.

DESCRIPTION OF THE PREFERRED EMBODIMENT

Figure 1:
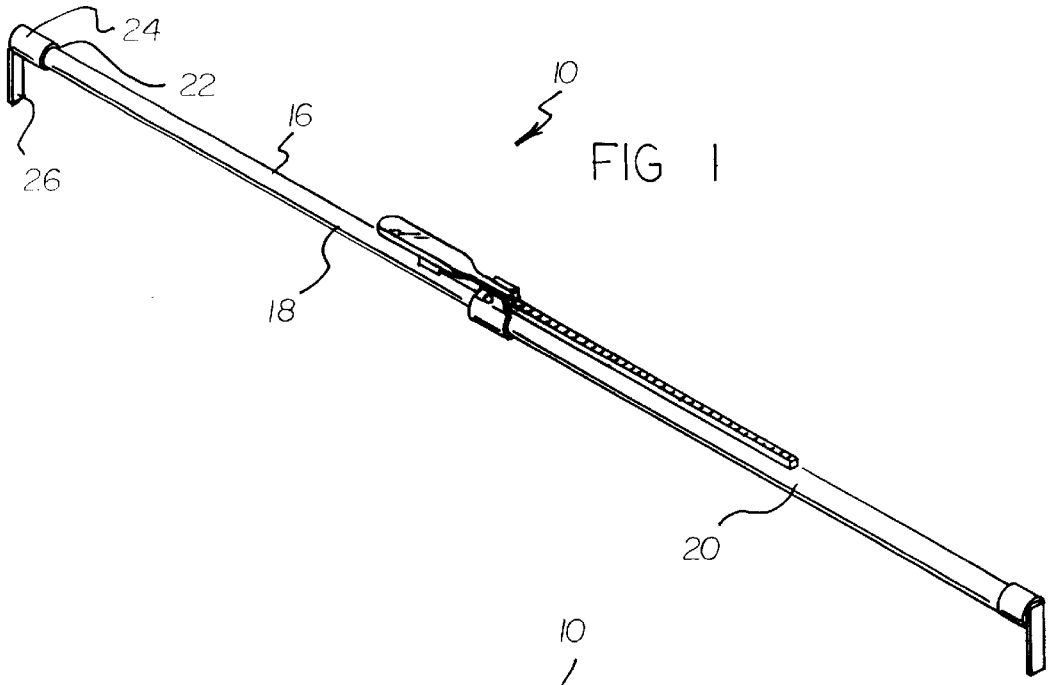
FIG. 1 is a perspective view of a new vehicle door locking system according to the present invention.

With reference now to the drawings, and in particular to FIGS. 1 through 4 thereof, a new vehicle door locking system embodying the principles and concepts of the present invention and generally designated by the reference numeral 10 will be described.

The present invention, as designated as numeral 10, is adapted for use with a pair of doors 12 of a vehicle adapted to pivot outward for allowing access to a cab. Each door has a slot 15 for receiving a sliding window therein. A pair of hollow rigid tubes 16 of a common length are provided including a first tube 18 with a first diameter. Associated therewith is a second tube 20 of a second diameter greater than the first diameter. During use, a first end of the first tube is slidably situated within a first end of the second tube.

Figure 2:
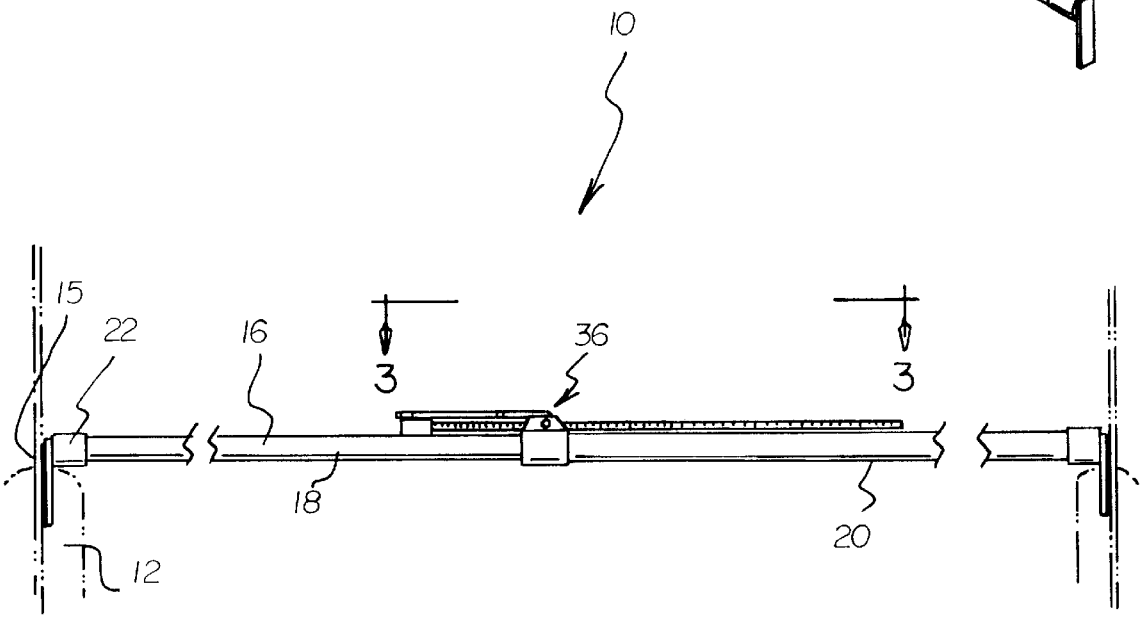
FIG. 2 is a side view of the present invention.

Also included is a pair of caps 22 each having a hollow cylindrical portion 24 with an open circular face and a planar rectangular plate 26 mounted to a closed face thereof. As shown in FIGS. 1 & 2, the plates extend in perpendicular relationship with an axis of the cylindrical portion. The cylindrical portions of the caps are each fixedly mounted to a second of the corresponding tube such that the plates extend downwardly and reside in vertical planes. Each plate preferably has a length at least twice the diameter of the associated tube.

FIGS. 3 & 4 best shows a teeth assembly 28 including a mounting block 30 secured to a top of the first tube adjacent the first end thereof. An elongated strip 32 has a first end coupled to a side face of the mounting block adjacent to a top face thereof. In such orientation, the strip is positioned in spaced parallel relationship with the first tube and extends past the first end thereof. The strip preferably has a length approximately equal to the first tube. It should be noted that the second end of the first tube is a free end. A top face of the strip has a plurality of equally spaced square cut outs 34 formed therein along an entire length thereof. For reasons that will become apparent hereinafter, each cut out and each space between the cut outs is about ⅛ of an inch in length.

Finally, a locking mechanism 36 is provided including a cylindrical sleeve 38 mounted on the first end of the second tube below the strip of the teeth assembly. A pair of parallel arms 39 are integrally coupled to sides of the sleeve and extend upwardly therefrom above the strip of the teeth assembly A lever lock includes an elongated handle 42 pivotally coupled at an end thereof between upper ends of the arms. Such pivotal coupling is effected about an axis perpendicular with respect to that of the tubes. The lever lock has a tab 44 fixedly coupled perpendicularly to the end of the handle above the strip of the teeth assembly.

During use, the handle has a raised orientation for allowing the free sliding of the first tube within the second tube. In addition, the handle has a lowered orientation for bringing the tubes together by about ⅛ of an inch and further locking their respective position.

As such, the tubes may be extended such that the plates of the caps are inserted within the slots of the doors. Further, the handle may be lowered to secure the same therebetween to preclude the doors from being opened.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A door locking system comprising, in combination:

a pair of doors of a vehicle adapted to pivot outward for allowing access to a cab, wherein each door has a slot for receiving a sliding window therein;

a pair of hollow rigid tubes of a common length including a first tube with a first diameter and a second tube of a second diameter greater than the first diameter, a first end of the first tube being slidably situated within a first end of the second tube;

a pair of caps each including a hollow cylindrical portion with an open circular face and a planar rectangular plate mounted to a closed face of the cylindrical portion and extending in perpendicular relationship with an axis of the cylindrical portion, whereby the cylindrical portions of the caps are each mounted to a second of the corresponding tube such that the plates extend downwardly and reside in vertical planes;

a teeth assembly including a mounting block secured to a top of the first tube adjacent the first end thereof, an elongated strip having a first end coupled to a side face of the mounting block adjacent to a top face thereof with the strip extending in spaced parallel relationship with the first tube and extending past the first end thereof, a top face of the strip having a plurality of equally spaced square cut outs formed therein along an entire length thereof, whereby each cut out and each space between the cut outs is about ⅛ of an inch in length; and a locking mechanism including a cylindrical sleeve mounted on the first end of the second tube, a pair of parallel arms integrally coupled to sides of the sleeve and extend upwardly therefrom above the strip of the teeth assembly, and a lever lock including an elongated handle pivotally coupled at an end thereof between upper ends of the arms about an axis perpendicular with respect to that of the tubes, the lever lock having a tab fixedly coupled perpendicularly to the end of the handle above the strip of the teeth assembly, the handle having a raised orientation for allowing the free sliding of the first tube within the second tube and a lowered orientation for bringing the tubes together by about ⅛ of an inch and further locking their respective position;

whereby the tubes may be extended such that the plates each extend within the associated slot and further the handle may be lowered to secure the same therebetween to preclude the doors from being opened.

2. A door locking system for use with a pair of doors of a vehicle adapted to pivot outward for allowing access to a cab, wherein each door has a slot for receiving a sliding window therein, the door locking system comprising:

a pair of rigid tubes of a common length at least one of which is hollow, the tubes including a first tube with a first diameter and a second tube of a second diameter greater than the first diameter, a first end of the first tube being slidably situated within a first end of the second tube;

a pair of caps each including a hollow portion with an open face and a plate mounted to a closed face of the hollow portion and extending in generally perpendicular relationship with an axis of the hollow portion, whereby the hollow portions of the caps are each mounted to a second of the corresponding tube such that the plates extend downwardly and reside in generally vertical planes;

a teeth assembly including a mounting block secured to a top of the first tube adjacent the first end thereof, an elongated strip having a first end coupled to a side face of the mounting block adjacent to a top face thereof with the strip extending in generally spaced parallel relationship with the first tube and extending past the first end thereof, a top face of the strip having a plurality of cut outs formed therein along an entire length thereof; and a locking mechanism including a sleeve mounted on the first end of the second tube, a pair of parallel arms integrally coupled to sides of the sleeve and extending upwardly therefrom above the strip of the teeth assembly, and a lever lock including an elongated handle pivotally coupled at an end thereof between upper ends of the arms about an axis generally perpendicular with respect to that of the tubes, the lever lock having a tab fixedly coupled to the end of the handle above the strip of the teeth assembly, the handle having a raised orientation for allowing the free sliding of the first tube within the second tube and a lowered orientation for bringing the tubes together and further locking their respective position;

wherein the tubes may be extended such that the plates each may extend within the associated slot and further the handle may be lowered to secure the same therebetween to preclude the doors from being opened.

* * * * *